US007273410B1

(12) United States Patent
Wang

(10) Patent No.: US 7,273,410 B1
(45) Date of Patent: Sep. 25, 2007

(54) GUIDING AND PRESSING DEVICE FOR A BELT SANDER

(76) Inventor: Tian-Wang Wang, P.O. Box 44-2049, Taichung (TW) 10668

( * ) Notice: Subject to any disclaimer, the term of this patent is extended or adjusted under 35 U.S.C. 154(b) by 0 days.

(21) Appl. No.: 11/646,512

(22) Filed: Dec. 28, 2006

(51) Int. Cl.
*B24B 21/00* (2006.01)

(52) U.S. Cl. ..... 451/311; 451/297

(58) Field of Classification Search ..... 451/311, 451/296, 297, 303, 309; 474/111
See application file for complete search history.

(56) References Cited

U.S. PATENT DOCUMENTS 3,127,712 A * 4/1964 Krogen et al. ..... 451/311
4,187,645 A * 2/1980 Lind ..... 451/297
5,860,854 A * 1/1999 Sakoh et al. ..... 451/297
6,106,388 A * 8/2000 Green ..... 451/297
6,537,142 B2 * 3/2003 Liou ..... 451/311
7,025,666 B1 * 4/2006 Wang ..... 451/296

* cited by examiner

*Primary Examiner*—Dung Van Nguyen
(74) *Attorney, Agent, or Firm*—Charles E. Baxley

(57) ABSTRACT

A guiding and pressing device for a belt sander includes two triangular guiding blocks or sheet-like inclined guiding blocks, which are disposed at suitable positions on a front side frame of the sander and near to a circulating path of a sand belt. The two guiding blocks have opposite inclined surfaces near an edge of the sand belt to restrict the circulating path of the sand belt without damaging the edge of the sand belt. In addition, an elastic pressing or push rod is disposed inside the sand belt and on a backside of the frame in order to frequently push the sand belt outwards and thus to keep the sand belt in a tightened state when the belt sander is sanding.

1 Claim, 6 Drawing Sheets

GUIDING AND PRESSING DEVICE FOR A BELT SANDER

BACKGROUND OF THE INVENTION (1) Field of the Invention

The invention relates to a guiding and pressing device for a sand belt, and more particularly to a device used in a belt sander to prevent a sand belt from skewing and to ensure the sand belt to be always in a tightened state.

(2) Description of the Prior Art

A belt sander having a sand belt, which is rotated at a high speed to sand or polish a wood surface, has been described in U.S. Pat. No. 7,025,666 to this applicant, in which some drawbacks in this kind of conventional sander have been improved. Thus, the sand belt in the belt sander may be replaced quickly, and the improvements on the absorption of the powder and chips or on the sanding effect of the workpiece, and on the lengthening of the lifetime of the sand belt can be obtained. However, this kind of sander still has some defects, which bring the inconvenience to the user in practical usage for many years.

First, when the sand belt is rotated at the high speed continuously, it is possible to cause the inconsistency in the reaction force due to the unsmooth wood surface contacting the sand belt or the uneven hardness of the wood surface contacting the sand belt. In addition, the sanding mechanism itself swings in a reciprocating manner, so the sand belt is laterally biased after a period of sanding time. If the sand belt is biased to a predetermined degree, the effect of sanding the wood may be influenced. In this case, the operator has to stop the machine and loosen and reset the sand belt, and then to tighten the sand belt to continue the sanding operation. Thus, the complicated operations have to be repeated after a predetermined period of time. In addition to the increase of the trouble of the operation, the sand belt may be broken to cause the extra loss.

Second, when the sand belt is rotated at the high speed, it must be in the tightened state so that the wood can be effectively sanded and polished. However, when the sand belt continuously sands the wood for a period of time, the sand belt naturally becomes loose so that the operator has to stop the machine every predetermined period of time, and then to adjust the distance between two transmission shafts to tighten the sand belt again. Thus, the sanding operation can be continued, but the operations are complicated.

SUMMARY OF THE INVENTION

In view of the defects of this kind of belt sander, the inventor has improved the prior art belt sander in order to provide a belt sander of the invention having a set of guiding blocks, which are disposed at two opposite sides of a frame and at suitable positions on a circulating path of a rotating sand belt and near to an edge of the sand belt. The guiding blocks have inclined surfaces to block and guide the rotating sand belt, which tends to be biased rightwards or leftwards, and to return to the normal circulating path instantaneously. Thus, the trouble of frequently adjusting the sand belt after stopping the machine can be eliminated.

Another object of the invention is to dispose an elastic pressing or push rod inside the sand belt and on a backside of the frame so that the sand belt is always kept in a well tightened state for sanding.

Still another object of the invention is to ensure the quality and the stability of the workpiece being sanded according to the automatic guiding and pressing functions of the two guiding blocks.

To achieve the above-identified objects and effects, the invention provides a belt sander including opposite guiding blocks on two sides of a circulating path of a sand belt. The guiding blocks automatically and immediately guide the sand belt, which is biased either leftwards or rightwards, so that the sand belt is always kept on the correct circulating path. In addition, an elastic push rod may be used to tighten the sand belt so that the sand belt is always kept in the best tightened state and the high-quality sanding operation can be performed.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

The structure of the invention will be described with reference to the accompanying drawings.

Figure 1:
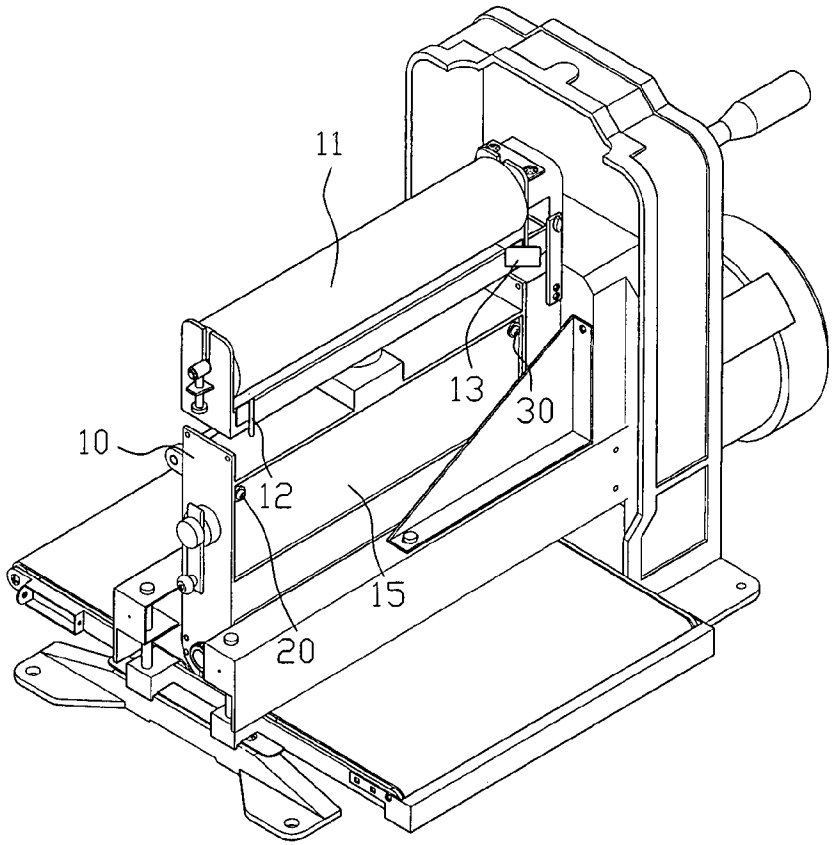
FIG. 1 is a pictorial view showing a sander of the invention.
Figure 2:
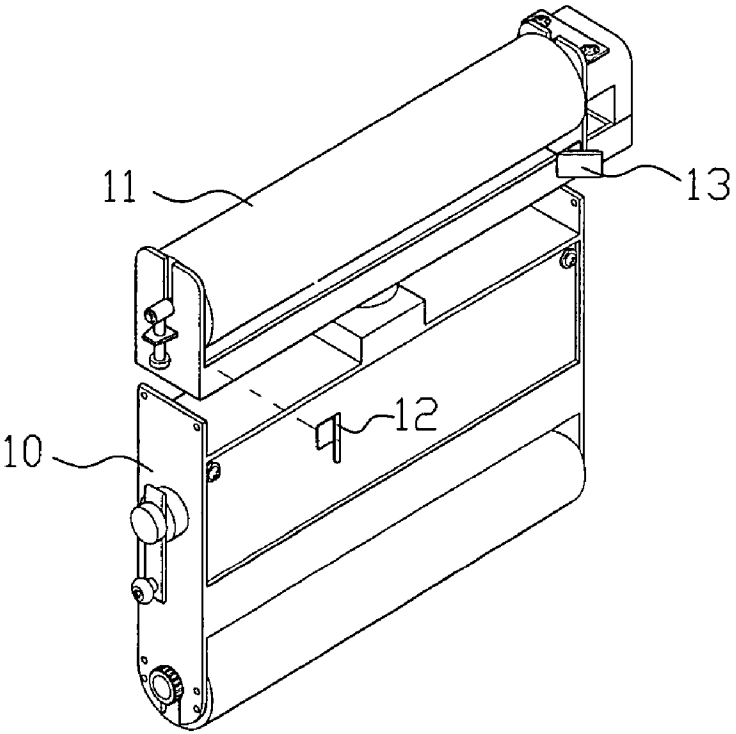
FIG. 2 is a schematically assembled illustration showing a frame of the sander of the invention.
Figure 3:
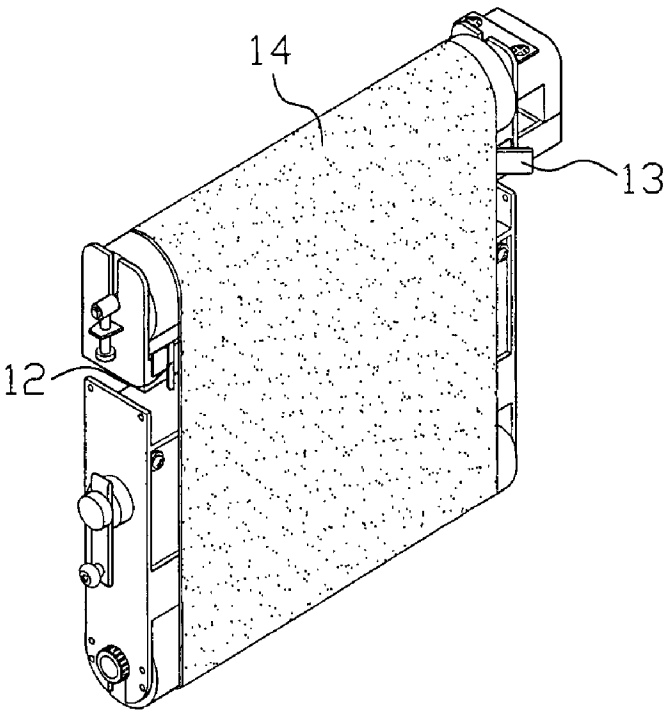
FIG. 3 is a schematically assembled illustration showing a sand belt disposed in the frame of the sander according to the invention.

As shown in FIGS. 1 to 3, a belt sander has a frame 10 and two guiding blocks 12 and 13 disposed at preferred positions (i.e., on two sides under an upper transmission shaft 11). Each of the guiding blocks 12 and 13 may be an inclined blocking sheet or has a triangular inclined surface. The guiding blocks 12 and 13 are disposed on two sides of a circulating path of a sand belt 14. Thus, when the sand belt 14 is being rotated at the high speed to sand a workpiece and biased by an external force, the sand belt 14, which is biased either leftwards or rightwards, is immediately blocked by the guiding block 12 or 13 and automatically guided back to a correct circulating path. In addition, because the guiding blocks 12 and 13 have inclined surfaces in contact with the sand belt 14, the sand belt 14 rotating at the high speed will not be damaged when the sand belt 14 touches the inclined surfaces and is guided back.

Next, as shown in FIG. 3, the two guiding blocks 12 and 13 are disposed near to the sand belt 14 so that the sand belt 14, which is biased by the external force, is immediately blocked and guided by the left or right guiding block 12 or 13. So, the sand belt 14 is always guided to ensure the normal operation.

Figure 4:
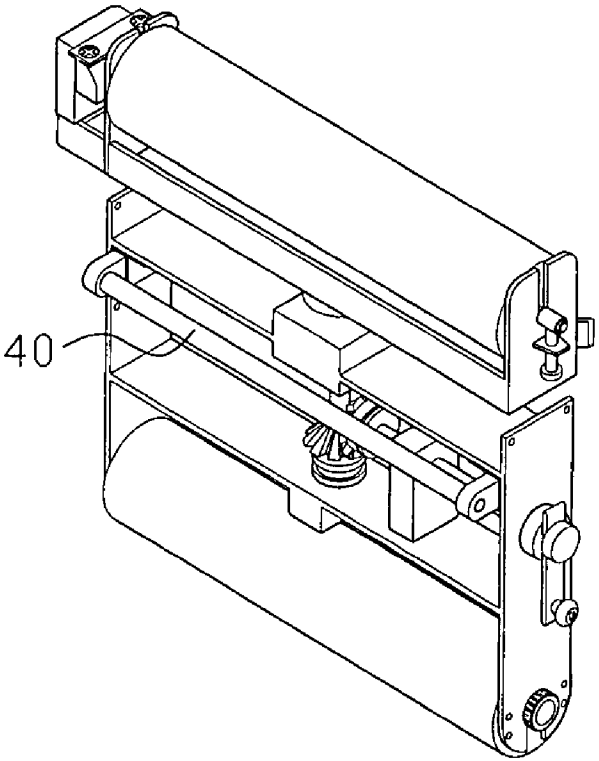
FIG. 4 is a schematically assembled illustration showing a backside of the frame of the sander of the invention.
Figure 5:
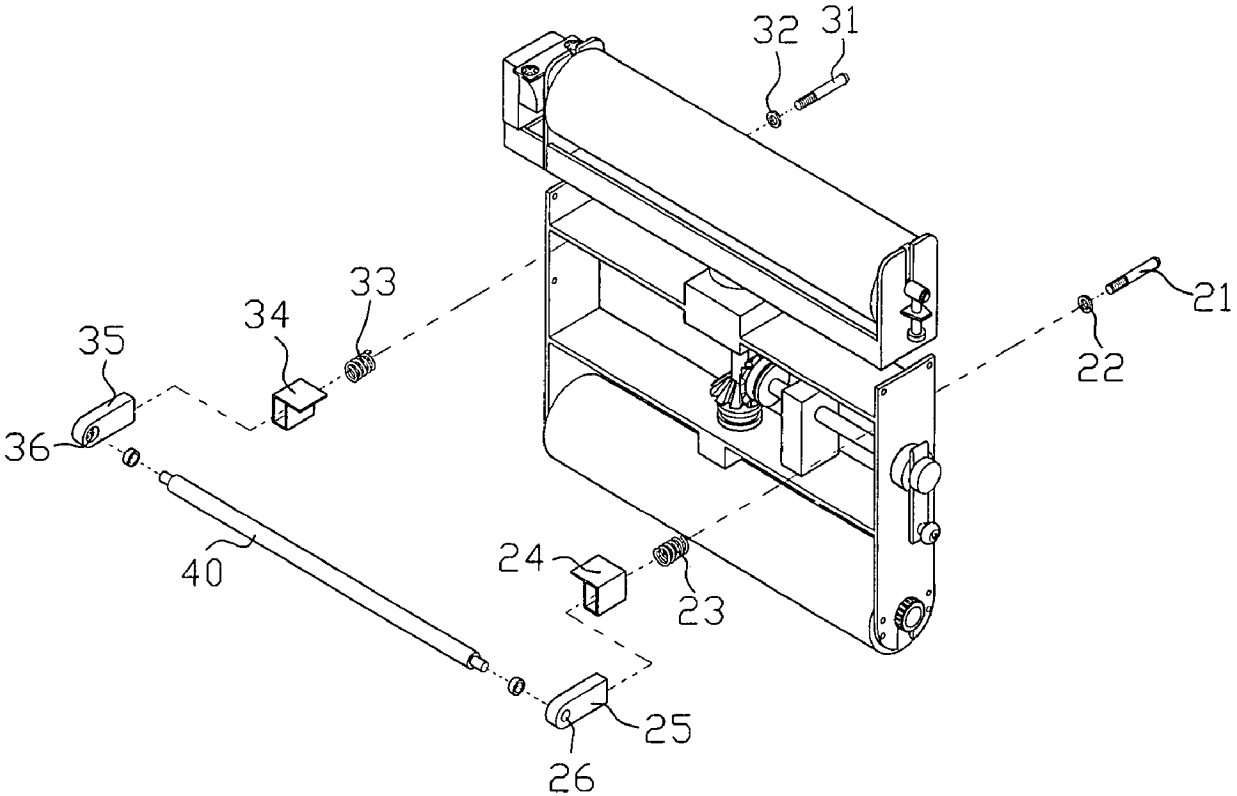
FIG. 5 shows an assembled state of an elastic pressing device of the invention.

As shown in FIGS. 1, 4 and 5, two sets of elastic supporting rod assemblies 20 and 30 are inserted into a baffle 15 on a front side of the frame 10. The two supporting rod assemblies 20 and 30 include spring fitting rods 21 and 31, washers 22 and 32, springs 23 and 33, fitting seats 24 and 34, and connectors 25 and 35, respectively. After each rod is assembled, a push rod 40 is inserted into two corresponding fitting holes 26 and 36 of the two connectors 25 and 35. Because the fitting rods 21 and 31 respectively correspond to the elastic supporting rod assemblies 20 and 30 fixed to the baffle 15 on the front side of the frame of FIG. 1, and the fitting seats 24 and 34 are fixed to the sidewall in the frame and have through holes, the two connectors 25 and 35 can be respectively inserted into the fitting seats 24 and 34 to contact the two springs 23 and 33. Thus, the two connectors 25 and 35, which are respectively restricted by the fitting seats 24 and 34, are pushed by the two compressive springs 23 and 33 so that the push rod 40 is always pushed outwards to have the proper function of elastically automatic adjustment.

Figure 6:
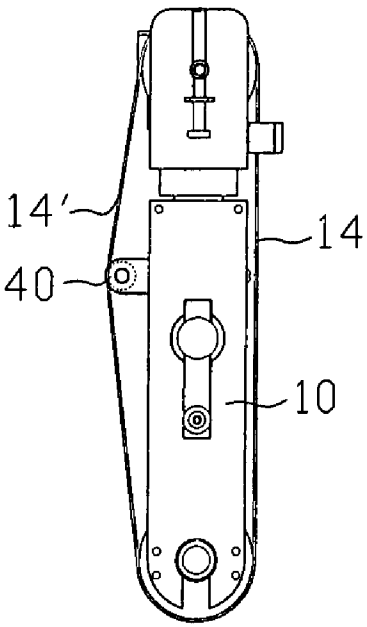
FIG. 6 shows the elastic pressing device for tensing the sand belt.

As shown in FIG. 6, when the sand belt 14 covers the frame 10 to sand the workpiece, the outward elastic force of the push rod 40 on the backside pushes the sand belt 14' on the backside of the frame outwards so as to keep the sand belt 14 on the front side of the frame in the tightened state. When the sand belt 14 gradually loosens with the continuous proceeding of the sanding operation, the tightened state can be always kept due to the outward and elastic expanding property of the push rod 40.

In summary, the invention utilizes the simple guiding blocks and the elastic pressing device having the outward and elastic expanding property. Thus, it is possible to eliminate the skew of the sand belt of the belt sander, the halt caused by the loose sand belt, the time-consuming adjustment, and the over-wear of the sand belt. So, the satisfaction of operating the belt sander can be greatly enhanced.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A belt sander comprising:

a frame including an upper transmission shaft, and a baffle at a front side of the frame;

a sand belt engaged around the upper transmission shaft, two guiding blocks attached to the frame and disposed near to two lateral side edges of the sand belt and on two sides of a circulating path of the sand belt, and the guiding blocks each including an inclined surface in contact with the sand belt to automatically guide the sand belt that is laterally biased;

two fitting seats fixed to the frame, two spring fitting rods inserted into the baffle of the frame;

two springs received in the fitting seats;

two connectors inserted into the fitting seats and restricted by the fitting seats and contacted with the springs, and a push rod attached to the connectors and contacted with the sand belt;

the springs pushing the push rod outward to push the sand belt and to keep the sand belt in a tightened state.

* * * * *